US010448769B1

(12) United States Patent
Cardin et al.

(10) Patent No.: US 10,448,769 B1
(45) Date of Patent: Oct. 22, 2019

(54) APPAREL FIXATION DEVICE

(71) Applicants: Jack R. Cardin, Boston, MA (US); Susan Soe, Somerville, MA (US); Rebecca Love, Marblehead, MA (US); Noah Hendler, Fairfield, CT (US); Anand Shankar, Malden, MA (US)

(72) Inventors: Jack R. Cardin, Boston, MA (US); Susan Soe, Somerville, MA (US); Rebecca Love, Marblehead, MA (US); Noah Hendler, Fairfield, CT (US); Anand Shankar, Malden, MA (US)

( * ) Notice: Subject to any disclaimer, the term of this patent is extended or adjusted under 35 U.S.C. 154(b) by 0 days.

(21) Appl. No.: 16/196,569

(22) Filed: Nov. 20, 2018

(51) Int. Cl.
*A47G 25/90* (2006.01)
*A44B 19/26* (2006.01)
*A44B 19/28* (2006.01)

(52) U.S. Cl.
CPC ..... *A47G 25/902* (2013.01); *A44B 19/262* (2013.01); *A44B 19/285* (2013.01)

(58) Field of Classification Search
CPC .. A44B 19/262; A44B 19/285; A47G 25/902; D06F 5/00; D06F 5/06; Y10T 24/344; Y10T 24/3443
USPC ..... 294/3.6
See application file for complete search history.

(56) References Cited

FOREIGN PATENT DOCUMENTS

| | | | | |
|---|---|---|---|---|
| DE | 9405703 U1 * | 5/1994 | ..... | A47C 31/06 |
| DE | 19608832 A1 * | 9/1997 | ..... | B62J 7/08 |
| WO | WO-0127512 A1 * | 4/2001 | ..... | F16L 3/237 |
| WO | WO-2006010219 A1 * | 2/2006 | ..... | D06F 55/02 |
| WO | WO-2006086185 A3 * | 9/2006 | ..... | E04D 12/00 |
| WO | WO-2007081992 A2 * | 7/2007 | ..... | B65H 75/36 |

* cited by examiner

*Primary Examiner* — Stephen A Vu
(74) *Attorney, Agent, or Firm* — Burns & Levinson LLP; Daniel McGrath

(57) ABSTRACT

An apparel fixation device includes a first, second, and third rigid member. The first rigid member is coupled to a first end of the second rigid member by a first flex member such that the second rigid member is substantially parallel to the first rigid member and a first opening is defined between the first rigid member and the second rigid member proximate to a second end of the second rigid member. The third rigid member is coupled to the second end of the second rigid member by a second flex member such that the third rigid member is substantially parallel to the second rigid member and a second opening is defined between the second rigid member and the third rigid member proximate to the first end of the second rigid member.

4 Claims, 4 Drawing Sheets

APPAREL FIXATION DEVICE

FIELD OF THE TECHNOLOGY

The subject disclosure relates to temporary fixation and assistance devices for apparel.

BACKGROUND OF THE TECHNOLOGY

It can be extremely difficult for people with certain disabilities to operate zippers. For people who have hemiparesis or arthritis, or who are missing an arm or hand, it can be almost impossible to operate a zipper without assistance. As a result, people with these conditions must either solicit the help of another individual to put on or remove apparel with a zipper, or avoid apparel with zipper's altogether. Similar problems can also arise with apparel which includes other attachment mechanisms, such as buckles, buttons, or the like.

SUMMARY OF THE TECHNOLOGY

In light of the needs described above, in at least one aspect, the subject technology relates to a fixation device which allows a user to zip or otherwise fasten clothing using only one hand.

BRIEF DESCRIPTION OF THE DRAWINGS

So that those having ordinary skill in the art to which the disclosed system pertains will more readily understand how to make and use the same, reference may be had to the following drawings.

DETAILED DESCRIPTION

Figure 1:
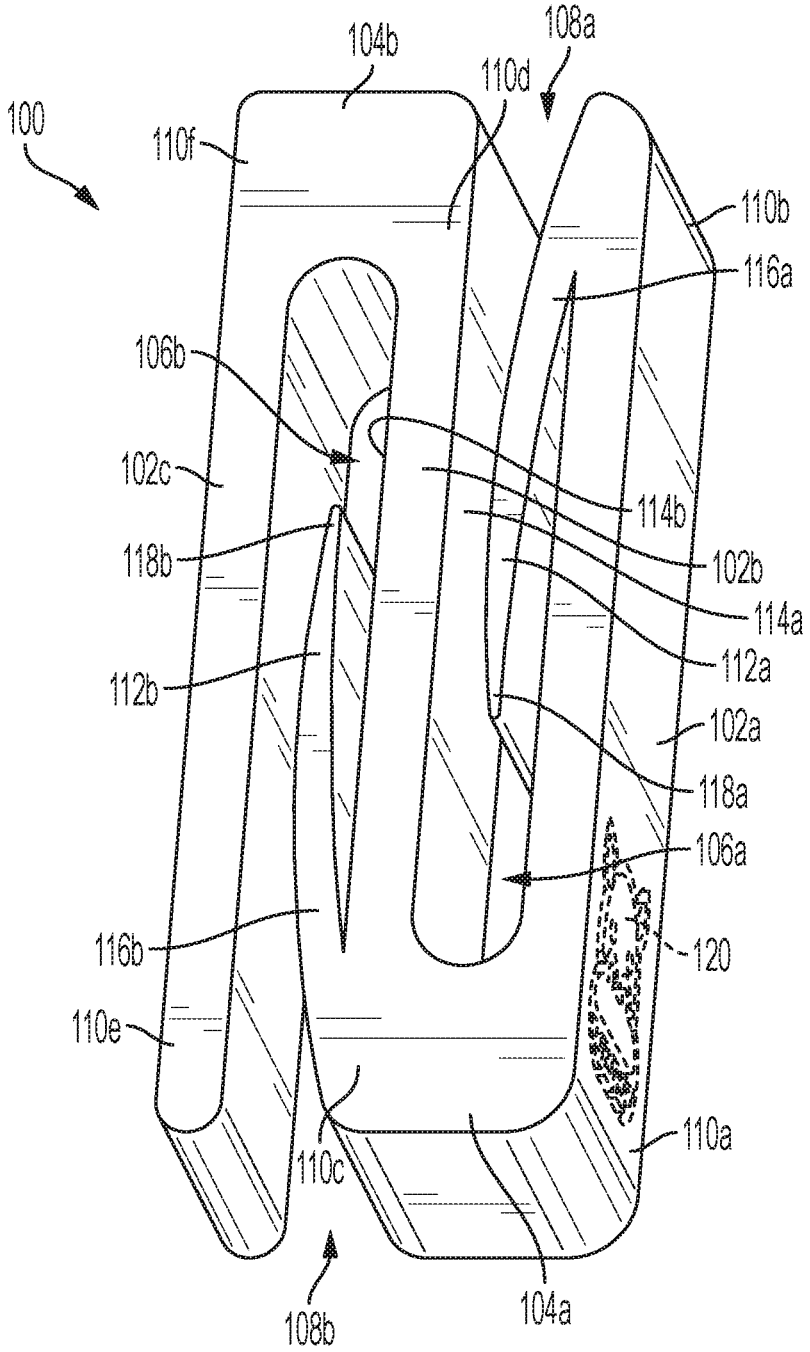
FIG. 1 is a left side/top perspective view of an apparel fixation device in accordance with the subject technology.

The subject technology overcomes problems faced by individuals with disabilities to a hand or arm. In brief summary, the subject technology allows an individual to control a zipper with a single hand. The advantages, and other features of the systems and methods disclosed herein, will become more readily apparent to those having ordinary skill in the art from the following detailed description of certain preferred embodiments taken in conjunction with the drawings which set forth representative embodiments of the subject technology. Like reference numerals are used herein to denote like parts. Further, words denoting orientation such as "upper", "lower", "distal", and "proximate" are merely used to help describe the location of components with respect to one another. For example, an "upper" surface of a part is merely meant to describe a surface that is separate from the "lower" surface of that same part. No words denoting orientation are used to describe an absolute orientation (i.e. where an "upper" part must always be on top).

Figure 2:
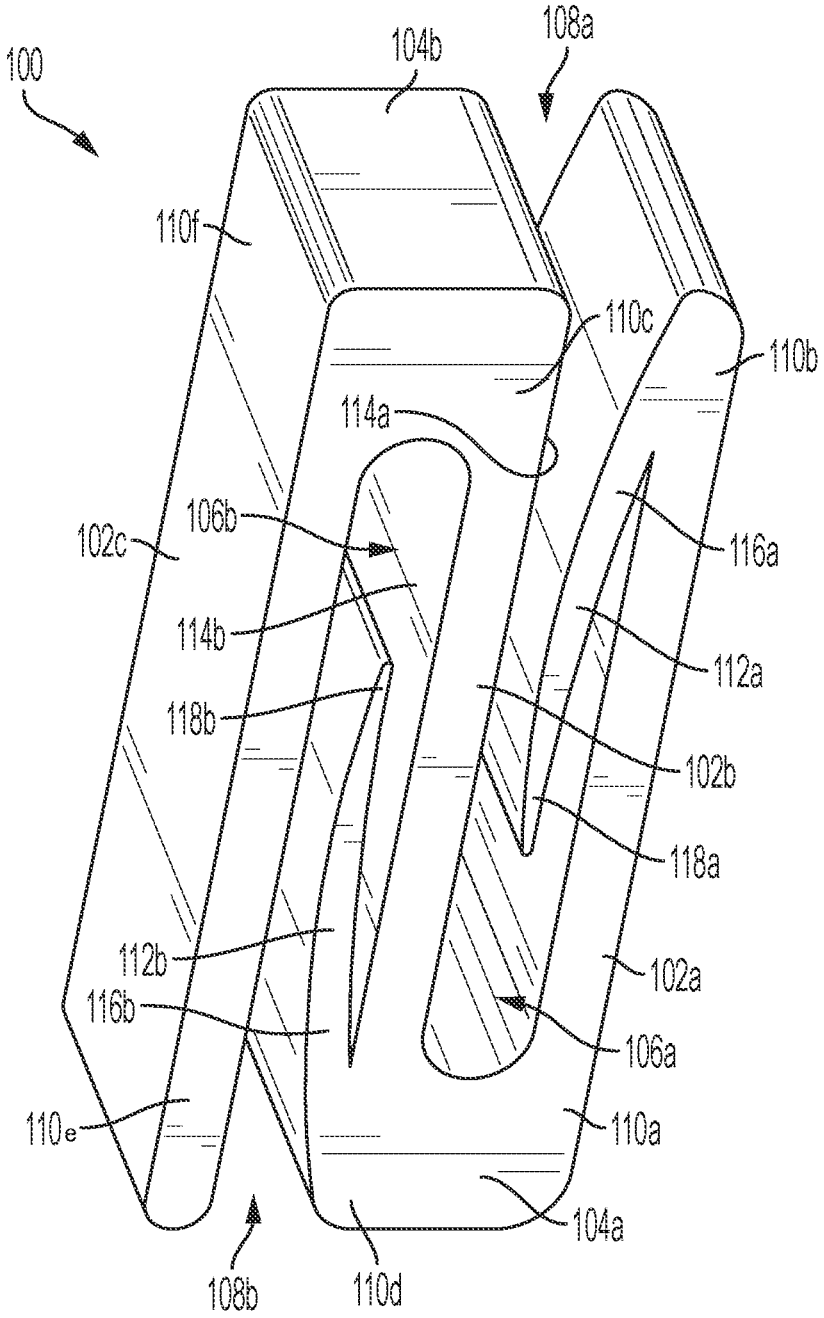
FIG. 2 is a left side/bottom perspective view of the apparel fixation device of FIG. 1.
Figure 3:
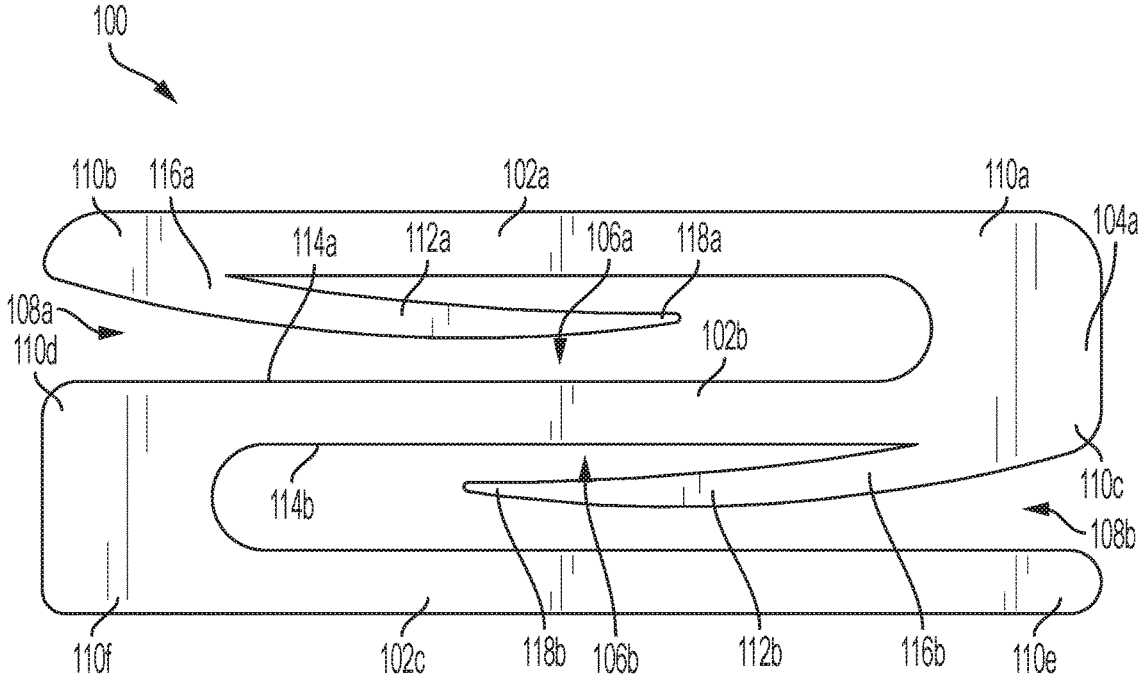
FIG. 3 is a left side view of the apparel fixation device of FIG. 1.
Figure 4:
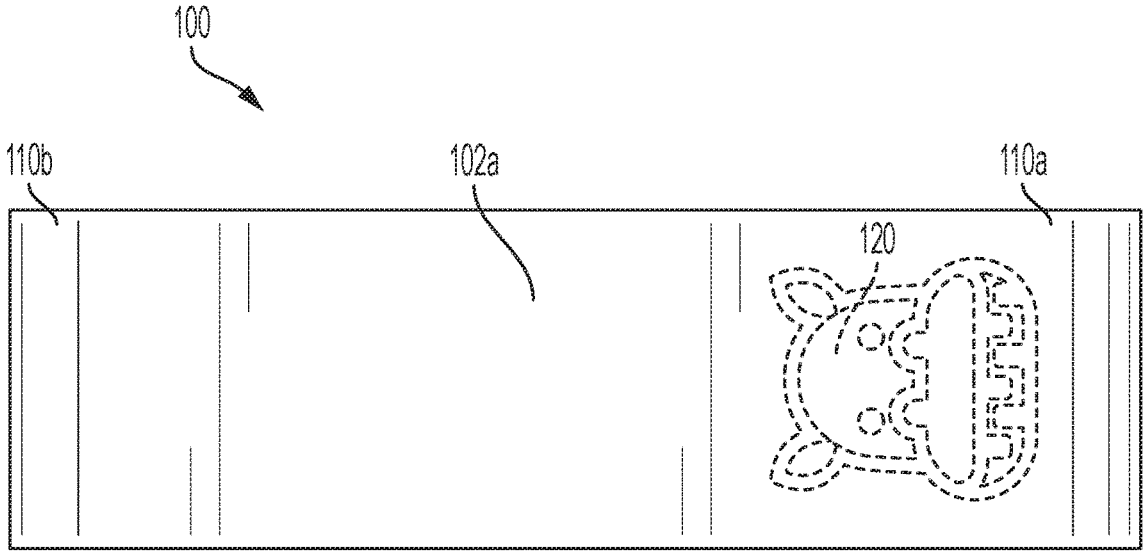
FIG. 4 is a top view of the apparel fixation device of FIG. 1.

Referring now to FIGS. 1-4, an apparel fixation device 100 in accordance with the subject technology is shown at different angles. The apparel fixation device 100 includes three separate rigid members 102*a*, 102*b*, 102*c* (generally 102) held parallel to one another by two flex members 104*a*, 104*b* (generally 104) such that channels 106*a*, 106*b* (generally 106) are defined between the rigid members 102. While the members 102, 104 are discussed herein as different components, it should be understand that the entire device 100 can be formed from a single unitary body to save on manufacturing costs. The flex members 104 can be shorter than the rigid members 102, and can flex by virtue of lever action from the long rigid members 102 being fixed to ends of the flex members 104. Openings 108*a*, 108*b* between the rigid members 102 and proximate to an end 110*a*-110*f* thereof allow objects (e.g. apparel and/or clothing) to pass between ends 110*a*-110*f* of the rigid members 102 to be clipped within the channels 106. To that end, the openings 108*a*, 108*b* can be between 1 and 5 mm wide in some examples. Wedges 112*a*, 112*b* within the channels 106 reduce the channel 106 cross-sectional width deeper within the channel 106 to further facility the clipping of objects between the rigid members 102. The first rigid member 102*a* can include a logo 120 to help identify the device 100 with a trademark, manufacturer, designer, or the like.

More specifically, in the example shown, the first rigid member 102*a* and second rigid member 102*b* are coupled at their respective first 110*a*, 110*c* by a first flex member 102*a*. The first flex member 104*a* holds the first rigid member 102*a* and the second rigid member 102*b* substantially parallel to one another such that a first channel 106*a* is formed in between. A first opening 108*a* is defined between the first rigid member 102*a* and the second rigid member 102*b* proximate to their second ends 110*b*, 110*d*. An end 110*f* of the third rigid member is coupled, by a second flex member 104*b*, to the second end 110*d* of the second rigid member 102*b*. The second flex member 104*b* holds the third rigid member 102*c* substantially parallel to the second rigid member 102*b* such that a second channel 106*b* is formed in between. A second opening 108*b* is defined between the second rigid member 102*b* and the third rigid member 102*c* proximate to the first end 110*c* of the second rigid member 102*b* and an end 110*e* of the third rigid member 102*c*. The first and second flex members 104*a*, 104*b* are attached to the second rigid member 102*b* such that the first rigid member 102*a* and the third rigid member 102*c* are proximate to opposite sides 114*a*, 114*b* of the second rigid member 102*b*.

A first wedge 112*a* is positioned within the first channel 106*a*. In the example shown, the first wedge 112*a* is attached to the first rigid member 102*a*. However, the first wedge 112*a* could also be attached to the second rigid member 102*b*. The first wedge 112*a* is positioned to have a narrow portion 116*a* proximate to the first opening 108*a*. The first wedge 112*a* gets wider deeper within the first channel 106*a* (e.g. as the first wedge 112*a* gets closer to the first flex member 104*a*), and has a wide portion 118*a* distal to the first opening 108*a*. Notably, width is used herein with respect to wide portions 118 to describe where a wedge 112 extends furthest across a channel 106 between rigid members 102 rather than where it is thickest. The first wedge 112*a* is designed to be flexible and to extend closer to the opposing rigid member within the channel 106*a* (i.e. the second rigid member 102*b*) nearer the wide portion 118*a*. This configuration allows the first wedge 112*a* to apply a greater force to an object the nearer the object is to the wide portion 118*a*.

Similarly, a second wedge 112*b* is positioned within the second channel 106*b*. In the example shown, the second wedge 112*b* is attached to the second rigid member 102*b*. However, the second wedge 112*b* could also be attached to the third rigid member 102*c*. The second wedge 112*b* is positioned to have a narrow portion 116*b* proximate to the second opening 108*b*. The second wedge 112*b* gets wider deeper within the second channel 106*b* (e.g. as the second wedge 112*b* gets closer to the second flex member 104*b*), and has a wide portion 118*b* distal to the second opening 108*b*. Like the first wedge 112*a*, the second wedge 112*b* is designed to be flexible and to extend closer to the opposing rigid member within the channel 106*b* (i.e. the third rigid member 102*c*) nearer the wide portion 118*b*. This configuration allows the second wedge 112*b* to apply a greater force to an object the nearer the object is to the wide portion 118*b*.

The apparel fixation device 100 is configured, as described above, to help a user zip up their clothing using only one hand. This can be particularly helpful for a person who is disabled and/or has full use of only one hand. To that end, the apparel fixation device 100 allows one piece of clothing (and/or other apparel) to be clipped between the first rigid member 102*a* and the second rigid member 102*b* while a second piece of clothing is clipped between the second rigid member 102*b* and the third rigid member 102*c*. One of the pieces of clothing acts as an anchor, holding the device 100 in place, while the other piece of clothing can be zipped by the user using only one hand.

For example, the user can clip the device 100 to their pants, by sliding the edge of their pant pocket through the opening 108*b* between the second and third rigid members 102*b*, 102*c*. The user can press the device 100 down to slide the edge of the pant pocket deep within the second channel 106*b*. The second wedge 112*b* will then engage the edge of the pant pocket to temporarily fasten the device 100 against the user's pants, the second wedge 112*b* tightening against the pant pocket as the pant pocket moves further into the channel 106*b*. One side of a jacket can then be inserted through the opening 108*a* between the ends 110*b*, 110*d* of the first and second rigid members 102*a*, 102*b*. The user can slide the jacket into the channel 106*a* where the first wedge 112*a* engages that side of the jacket to temporarily fasten that side of the jacket to the device 100. Since the device 100 is also attached to the user's pants, the jacket is attached to a fixed location of the user's pants, meaning it is held in place by the device 100. In this way, the device 100 acts as a second hand for the user as they zip the jacket by holding one side of the jacket in place. The user can then use one hand to grab the other side of the jacket and engage the zipper with the side of the jacket that is held in place by the device. The jacket can then be zipped by the user with only one hand. Notably, while zipping up a jacket is used by way of example for how the device 100 may be operated, this is not meant to be limiting and it should be understood that the device 100 can be used for other applications as well. For example, the device 100 can be used to help button or buckle an article of clothing, tie a ribbon, fasten a belt, or attach other pieces of apparel.

The device 100 can be made from a material that allows for flexation while still maintaining some structurally form, as described above. Therefore the material can be a PLA (polyactic acid) plastic 3D printed with a filament diameter of about 1.75 mm (+/00.03 mm). The device 100 can be 3D printed at a print temperature of between 190-220 degrees Celsius. In other cases, different kinds of plastics may also be used, as would be understood by one of skill in the art.

All orientations and arrangements of the components shown herein are used by way of example only. Further, it will be appreciated by those of ordinary skill in the pertinent art that the functions of several elements may, in alternative embodiments, be carried out by fewer elements or a single element. Similarly, in some embodiments, any functional element may perform fewer, or different, operations than those described with respect to the illustrated embodiment. Also, functional elements shown as distinct for purposes of illustration may be incorporated within other functional elements in a particular implementation.

While the subject technology has been described with respect to preferred embodiments, those skilled in the art will readily appreciate that various changes and/or modifications can be made to the subject technology without departing from the spirit or scope of the subject technology. For example, each claim may depend from any or all claims in a multiple dependent manner even though such has not been originally claimed.

What is claimed is:

1. An apparel fixation device comprising:

a first rigid member;

a second rigid member having a first end and a second end, the first rigid member coupled to the first end by a first flex member such that: the second rigid member is substantially parallel to the first rigid member defining a first channel between the first rigid member and the second rigid member; and a first opening is defined between the first rigid member and the second rigid member proximate to the second end;

a third rigid member coupled to the second end by a second flex member such that the third rigid member is substantially parallel to the second rigid member defining a second channel between the second rigid member and the third rigid member; and a second opening is defined between the second rigid member and the third rigid member proximate to the first end;

a first wedge within the first channel having a first narrow portion proximate to the first opening and a first wide portion distal to the first opening; and a second wedge within the second channel having a first narrow portion proximate to the first opening and a first wide portion distal to the first opening.

2. The apparel fixation device of claim 1, wherein the wedges are flexible.

3. The apparel fixation device of claim 2, wherein:

the first wedge is configured to apply a greater force to an object within the first channel the nearer the object is to the first wide portion; and the second wedge is configured to apply a greater force an object within the second channel the nearer the object is to the second wide portion.

4. The apparel fixation device of claim 3, wherein:

the first and second openings are each substantially between 1 and 5 mm; and the apparel fixation device is a unitary body of PLA plastic material.

* * * * *